US005651325A

United States Patent [19]

Conley, Jr.

[11] Patent Number: 5,651,325

[45] Date of Patent: *Jul. 29, 1997

[54] CLAMP HAVING ADJUSTABLE PRESSER MEMBERS

[75] Inventor: Ralph F. Conley, Jr., Miamisburg, Ohio

[73] Assignee: MIM Industries, Inc., Miamisburg, Ohio

[ * ] Notice: The term of this patent shall not extend beyond the expiration date of Pat. No. 5,509,367.

[21] Appl. No.: 588,350

[22] Filed: Jan. 18, 1996

Related U.S. Application Data

[60] Division of Ser. No. 976,557, Nov. 16, 1992, Pat. No. 5,509,367, which is a continuation-in-part of Ser. No. 735, 822, Jul. 25, 1991, Pat. No. 5,445,090.

[51] Int. Cl.[6] ..... D05B 21/00

[52] U.S. Cl. ..... 112/470.14; 112/103; 269/266

[58] Field of Search ..... 112/470.14, 470.06, 112/470.07, 470.09, 475.04, 475.05, 475.18, 475.19, 103, 102.5, 235; 38/102.2; 269/266, 73, 254 CS

[56] References Cited

U.S. PATENT DOCUMENTS

| | | | |
|---|---|---|---|
| 824,394 | 6/1906 | Warner | 269/266 X |
| 2,902,958 | 9/1959 | Voight | 112/235 |
| 4,598,488 | 7/1986 | Inteso | 112/103 X |
| 4,763,587 | 8/1988 | Frye | 112/470.14 X |
| 5,317,981 | 6/1994 | Hashiride et al. | 112/102.5 |
| 5,509,367 | 4/1996 | Conley, Jr. | 112/103 X |

FOREIGN PATENT DOCUMENTS

| | | | |
|---|---|---|---|
| 630323 | 10/1978 | U.S.S.R. | 112/114 |

*Primary Examiner*—Peter Nerbun
*Attorney, Agent, or Firm*—Jacox, Meckstroth & Jenkins

[57] ABSTRACT

A clamp is provided for use in a sewing machine. The clamp includes a frame and at least one adjustable presser member associated with the frame. The adjustable presser member applies a preselected amount of pressure to a workpiece located in a sewing machine and the clamp is adapted to be used with workpieces having varying thicknesses.

32 Claims, 4 Drawing Sheets

CLAMP HAVING ADJUSTABLE PRESSER MEMBERS

RELATED APPLICATION

This is a division of application Ser. No. 07/976,557 filed Nov. 16, 1992, now U.S. Pat. No. 5,509,367, which is a continuation-in-part of Ser. No. 07/735,822 filed Jul. 25, 1991, now U.S. Pat. No. 5,445,090.

BACKGROUND OF THE INVENTION

1. Field of the Invention

This invention relates to a clamp, and more particularly, it relates to a clamp having an adjustable workpiece engaging presser member whereby the clamp may be used on workpieces of varying thicknesses.

2. Description of Related Art

In the sewing industry, it is common to provide a clamp at a sewing station to firmly hold a workpiece in position on a support surface underneath a sewing head whereby workpieces may undergo a repetitive sewing operation with the clamp operating to engage with each of the workpieces prior to the sewing operation being initiated. Typically, the supporting surface and lower surface of the clamp for engaging the workpiece are substantially planar such that a workpiece have a uniform thickness will be clamped with a substantially uniform clamping force by the clamp.

An example of a typical prior art clamp is seen in U.S. Pat. No. 4,763,587 which shows a clamp frame movable in a vertical direction for engagement with and disengagement from a workpiece. The frame forms a boundary around a central sewing area to facilitate the prevention of tenting during the sewing operation.

A problem associated with prior art clamps is that a workpiece having a varying thickness through the clamped area will not receive a uniform clamping force. Thus, it is possible for a workpiece of variable thickness to be improperly clamped such that the sewing of the workpiece may be adversely affected if the work-piece should move relative to the clamp.

Still another problem of prior art clamps is that the clamping pressure applied by the clamp is not adjustable at the clamping surface such that a smaller clamping force may be applied to a thin workpiece than to a thick workpiece.

SUMMARY OF THE INVENTION

Accordingly, there is a present need to provide a clamp which provides an adjustable clamping pressure for clamping a workpiece against a clamping surface in a sewing machine.

In one aspect, this invention includes a clamp for securing a workpiece against a clamping surface in a sewing machine, said clamp comprising a frame; and at least one adjustable presser member associated with said frame, said presser member being adjustable to permit the clamp to apply a preselected amount of pressure to the workpiece located on the clamping surface.

In another aspect, the presser member may comprise a plurality of presser members extending from a lower side of the frame for engaging a workpiece under the frame. The presser members may comprise screw members such that rotation of any one presser member causes the extension of that presser member from the frame to be altered. Alternatively, the presser member may comprise a biasing element for biasing an engaging surface into engagement with the workpiece.

In a further aspect, this invention includes a method of clamping a workpiece to a clamping surface in a sewing machine, said method comprising the steps of: positioning a clamp frame in operative relationship with said clamping surface; and adjusting a presser member relative to said clamp frame to apply a preselected amount of pressure to a workpiece on said clamping surface.

In yet another aspect of the invention, the method step of adjusting the presser member further includes engaging a workpiece of varying thickness under the clamp frame at a plurality of locations along the clamp frame.

Therefore, it is an object of the present invention to provide a clamp for a sewing machine wherein the clamp is capable of clamping a workpiece to a clamping surface with a preselected amount of pressure.

Other objects and advantages of the invention will be apparent from the following description, the accompanying drawings, and the appended claims.

DETAILED DESCRIPTION OF THE PREFERRED EMBODIMENT

Figure 1:
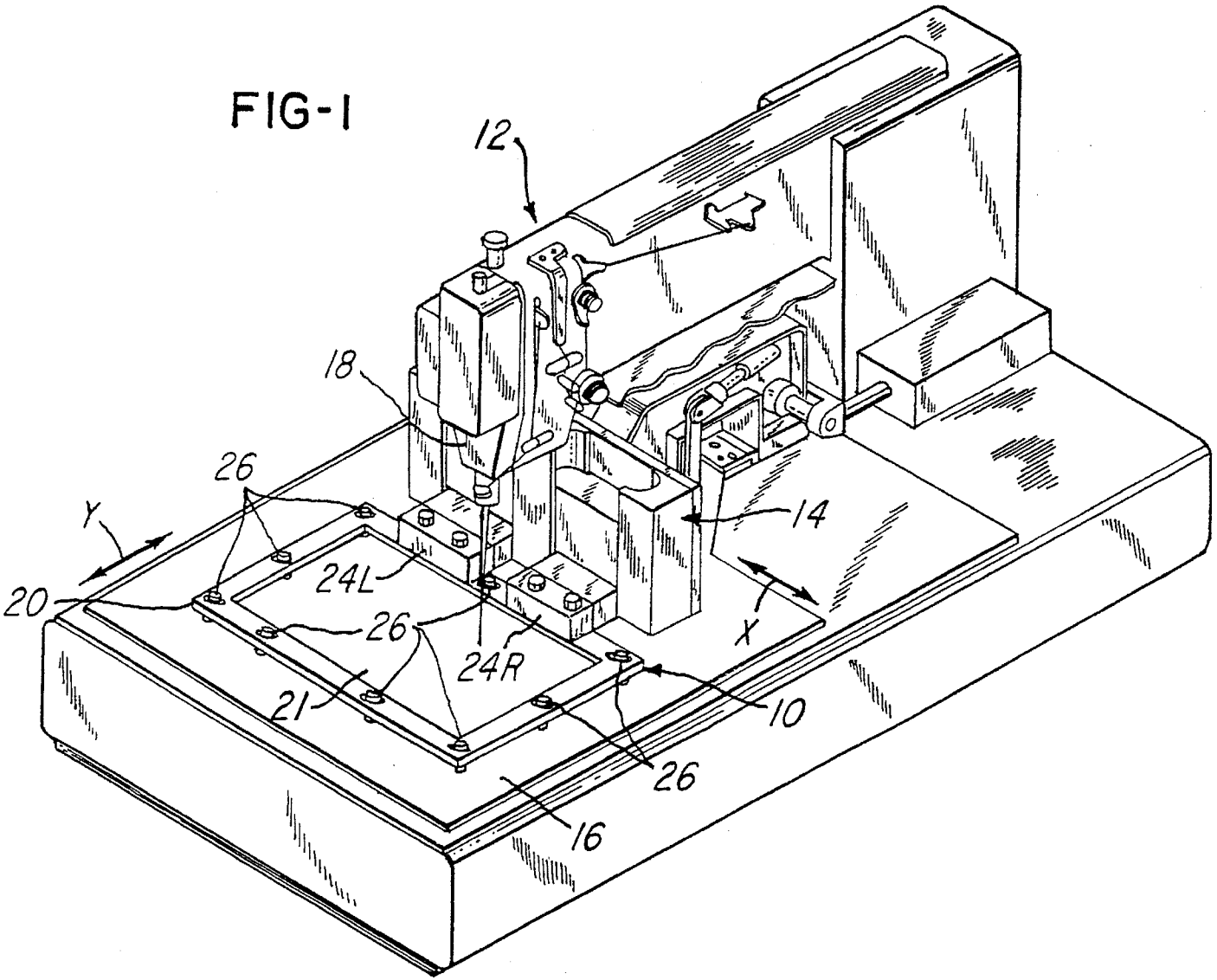
FIG. 1 is a perspective view of a preferred embodiment of this invention mounted to a sewing machine.

Referring to FIG. 1, the clamp 10 of the present invention is shown attached to a sewing machine 12. The clamp 10 is designed to be used within a conventional sewing machine such as a programmable sewing machine capable of moving the sewing clamp 10 in orthogonal X and Y directions to sew a predetermined stitch pattern on a workpiece, as described in U.S. Pat. No. 4,763,587, which patent is incorporated herein by reference. The clamp 10 is mounted to a movable support 14 which may be actuated by a programmable controller (not shown) of the sewing machine 12 for horizontal movement in the X and Y directions, as well as to move the clamp 10 vertically into and out of contact with a workpiece supported on a clamping surface 16 located under a sewing head 18 of the sewing machine 12.

Figure 2:
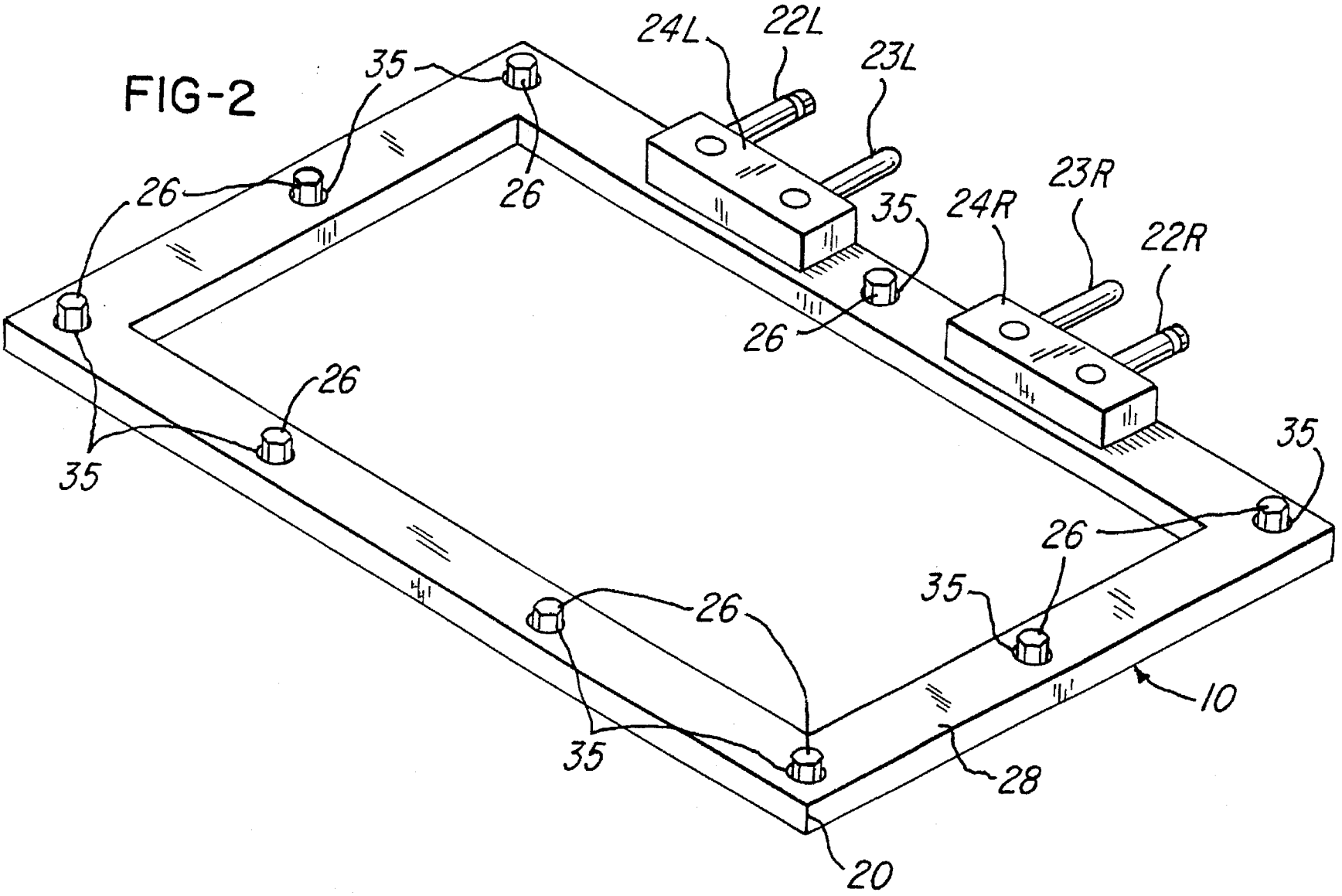
FIG. 2 is a perspective view of the clamp shown detached from the sewing machine.

Referring also to FIG. 2, the clamp of the present invention includes a frame 20 which is adapted to be attached to the movable support 14 by any conventional manner, such as a detachable connector system including pins 22R, 23R and 22L, 23L mounted to the frame 20 by respective mounting blocks 24R and 24L. The pins 22R, 23R, 22L, 23L are used to attach the frame 20 to the movable support 14 in a manner similar to that described with regard to the clamp of the aforementioned U.S. Pat. No. 4,763,587. In addition, the frame 20 surrounds a central aperture 21 to define a stitch area for sewing a workpiece.

Figure 3:
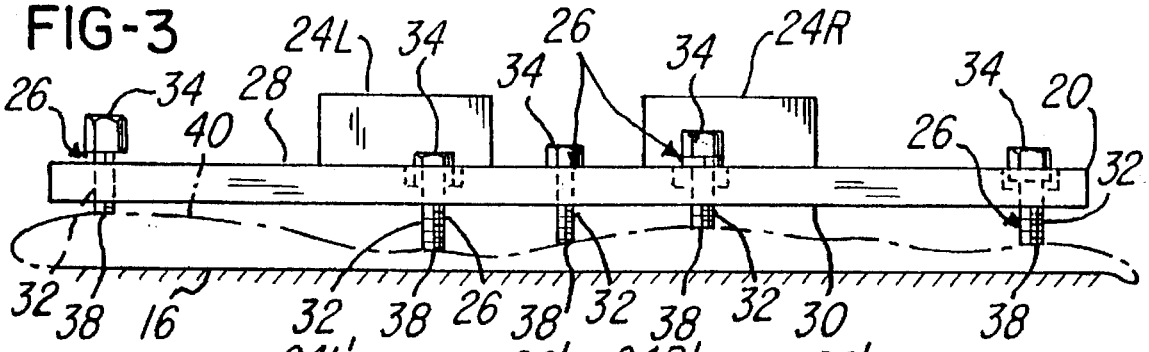
FIG. 3 is a front elevational view of the clamp of FIG. 2.

As may be seen in FIGS. 2 and 3, the clamp 10 is provided with a plurality of presser members 26 passing through the frame 20 from an upper side 28 thereof to a lower side 30. It should be understood that although a plurality of presser members 26 is shown in the present embodiment, the invention may be practiced using only a single presser member, as well as fewer or greater presser members 26 than that shown in the present embodiment, depending upon the particular clamping requirements of the sewing operation.

As may be best seen in FIG. 3, each of the presser members 26 includes a threaded shank 32 which is threadably engaged within respective threaded apertures of the frame 20. In addition, a head 34 is attached to the respective shanks 32 whereby the presser members 26 may be rotated to vary the extension of the shanks 32 from the lower surface 30 of the frame 20. The frame 20 preferably includes recesses 35 formed in the upper surface 28 for receiving the heads 34.

Each of the presser member shanks 32 defines a substantially planar engaging surface 38 at the lower end thereof for engaging a workpiece 40 to thereby clamp the workpiece 40 against the clamping surface 16. Thus, the presser members 26 are adjustable independently of each other wherein rotation of any one of the members 26 results in the spacing of that member's engaging surface 38 relative to the lower frame surface 30 being altered to alter the amount of pressure applied against the workpiece. In other words, the engaging surfaces 38 may be positioned to engage a workpiece 40 having a varying thickness whereby the clamp 10 will apply a preselected amount of pressure at each point of contact between the presser members 26 and the workpiece 40.

It should be noted that although the head 34 is illustrated as a thumbscrew-type head in the present embodiment, other configurations for the head 34 may be provided. For example, the head 34 may be formed with an aperture or slot for receiving a tool to rotate the presser member 26.

Figure 4:
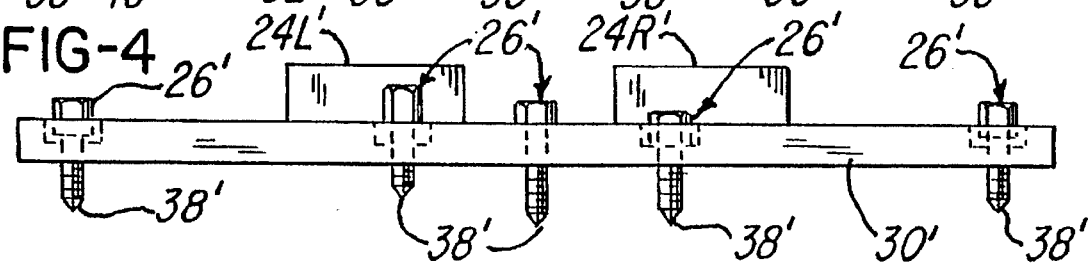
FIG. 4 is a view similar to FIG. 3 wherein alternative presser members are provided.

FIG. 4 illustrates an alternative configuration for the embodiment of FIG. 3 wherein similar elements are labeled with the same reference numeral primed. The clamp 10' includes frame 20' which is substantially the same as the above-described frame 20 and the presser members 26' have been altered to include a pointed engaging surface 38'. The presser members 26' operate in the same manner as the above-described presser members 26 wherein the extension of the pointed engaging surfaces 38' from the lower surface 30' of the frame 20' may be varied. The pointed engaging surfaces 38' provide point contact with a workpiece to positively locate the workpiece relative to the frame 20'.

Figure 5:
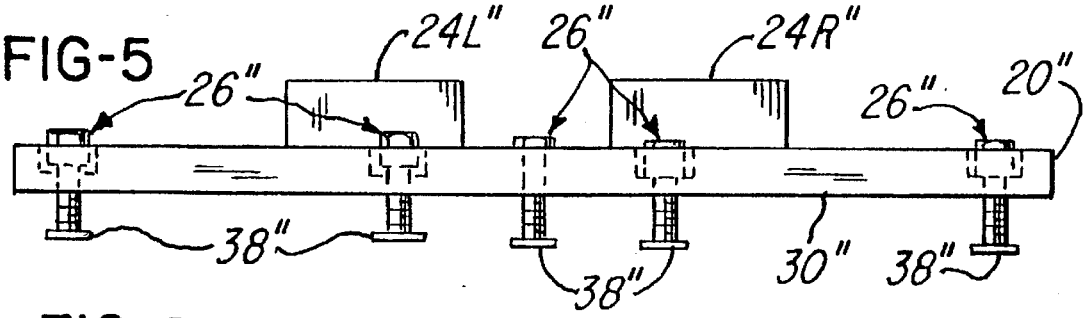
FIG. 5 is a view similar to FIG. 3 showing another configuration for the presser members.

FIG. 5 illustrates a further alternative configuration of the embodiment of FIG. 3 wherein similar elements are labeled with the same reference numeral double primed. In this embodiment, the engaging surface 38" of each of the presser members 26" comprises a disk-shaped foot 38" whereby a distributed pressure may be applied to a workpiece located underneath the frame 20". The feet 38" provide for a distributed pressure force to be applied by each of the presser members 26" as the workpiece is held in place. Otherwise, the presser members 26" and frame 20" operate in a manner similar to that described with regard to the configurations of FIGS. 3 and 4. In addition, it should be noted that a combination of the presser members 26, 26', 26" may be provided on a single frame, depending on the nature of the workpiece to be clamped, as well as requirements for variations in clamping force to be applied.

Figure 6:
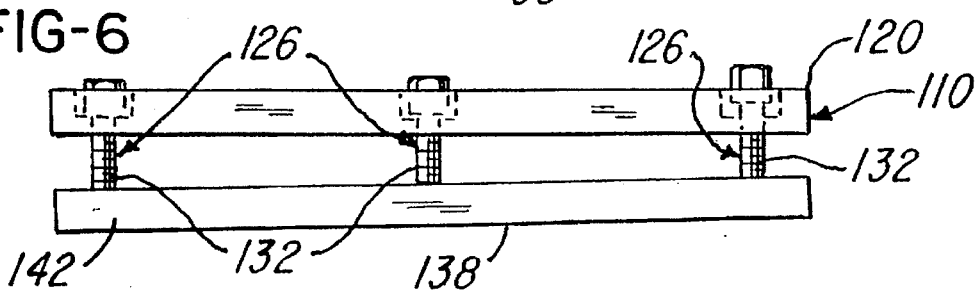
FIG. 6 is a front elevational view of a second embodiment of the present invention.

An alternative embodiment of the present invention is shown in FIG. 6 which illustrates a clamp 110 having a clamp frame 120 similar to the clamp frame of the previous embodiment and a plurality of presser member elements 126 threadably engaged with the frame 120 in a manner similar to the presser members 26 of the previous embodiment. The lower end of the shanks 132 for the presser elements 126 are rotatably engaged with a bar 142 which defines an engaging element having an engaging surface 138 on the lower side thereof. The lower end of the presser elements 126 may be connected to the bar 142 by any conventional means, such as by a ball and socket connection (not shown) or any other suitable connection which permits rotation of the presser elements 126 while remaining in engagement with the bar 142. Thus, it should be apparent that rotation of the presser member elements 126 results in the orientation of the bar 142 being varied relative to the frame 120 to thereby accommodate workpieces having varying thicknesses.

In addition, it should be noted that in an alternative configuration of the clamp 110, the presser elements 126 may remain in a fixed vertical position and be rotatable relative to the frame 120 while the lower ends of the presser elements may be threadably engaged with the bar 142. Thus, rotation of the presser elements 126 will result in relative vertical movement of the bar 142 to alter the orientation of the bar 142 relative to the frame 120.

Figure 7:
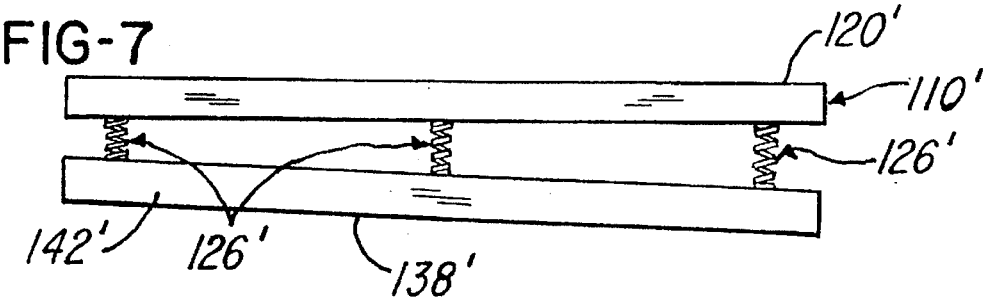
FIG. 7 shows an alternative configuration for the embodiment of FIG. 6.

FIG. 7 illustrates an alternative configuration of the embodiment of FIG. 6 wherein similar elements are labeled with the same numeral primed. The clamp 110' includes a frame 120' supporting a plurality of coil springs forming resilient presser member elements 126' for resiliently mounting a bar 142' forming the engaging portion of the clamp 110'. The clamp 110' operates to resiliently bias an engaging surface 130' of the bar 142' into engagement with a workpiece, and the presser member elements 126' act to permit the engaging surface 138' to move vertically and thereby accommodate variations in thickness of the workpiece.

It should be noted that although the clamps 110, 110' of FIGS. 6 and 7 depict a rigid bar 142, 142', the bars 142, 142' may be formed as flexible strips whereby the engaging surfaces 138, 138' will be configured as smoothly contoured engaging surfaces to follow the contours of a particular workpiece.

From the above description, it should be apparent that the present invention provides a clamp including an adjustable engaging surface portion whereby workpieces of different thicknesses and/or varying thicknesses across the workpiece may be engaged with a preselected pressure such that a predetermined clamping force may be applied to the workpiece. It should also be apparent that the presser member for engaging the workpiece may be configured either as a plurality of elements or as a single element such as a bar or strip element for engaging the workpiece with a predetermined pressure, and that the predetermined pressure may be regulated by moving the engaging surface of the presser member relative to a frame for the clamp and may be further controlled by regulating the size of the presser member surface contacting the workpiece such as by providing the surface as the end of a screw or as a continuous bar or strip.

It should also be noted that although a particular configuration or shape for the clamp frame has been shown, the present invention is not limited to this specific shape or type of clamp and alternative shapes or types of clamps may be provided to accommodate different stitch patterns and workpiece configurations, or the present invention may be incorporated into a workpiece pallet. For example, the invention may comprise a clamp frame mounted for pivotal or other movement on a workpiece pallet wherein the workpiece pallet forms a movable clamping surface in a sewing machine for cooperating with the presser members to clamp a workpiece.

Figure 8:
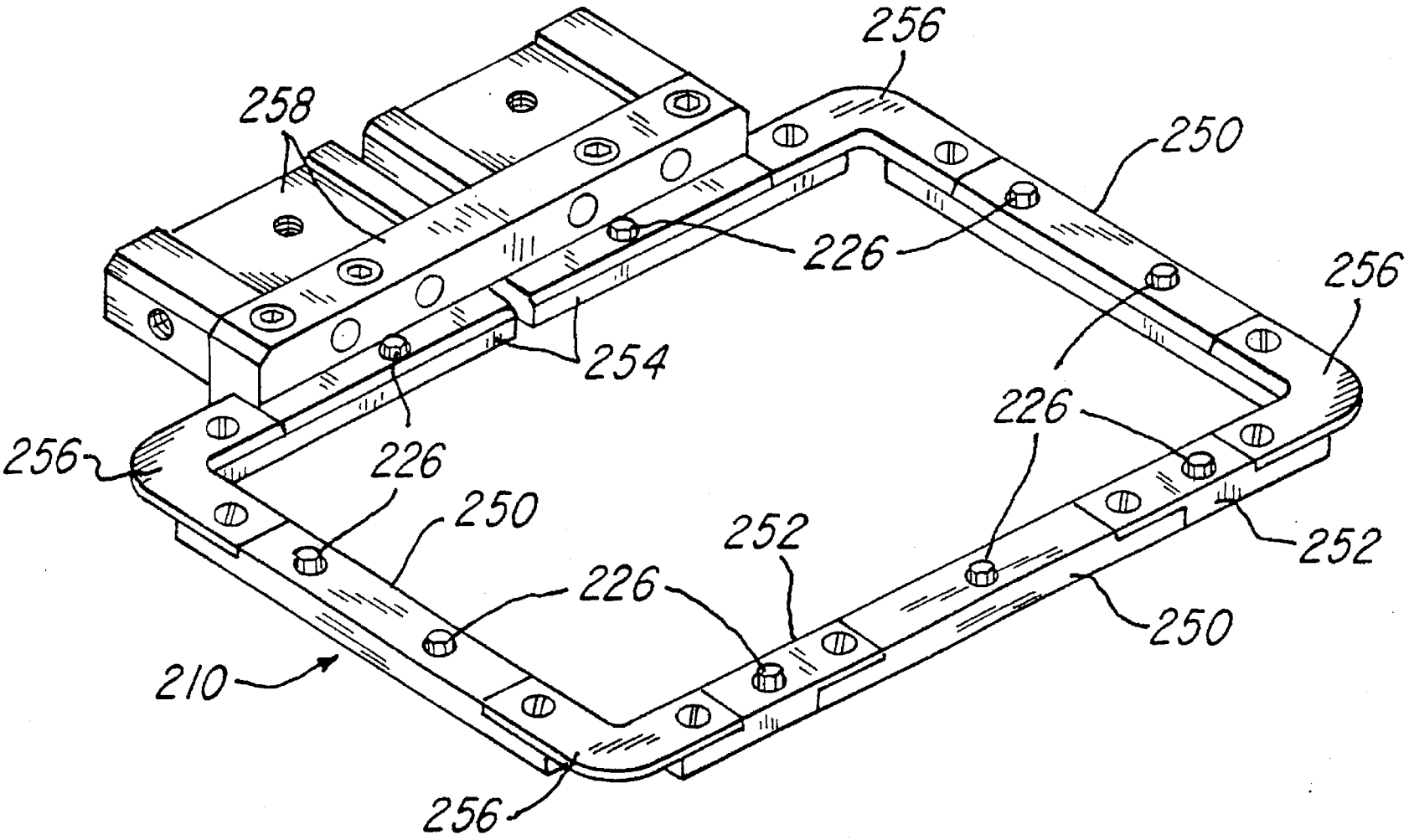
FIG. 8 is a perspective view showing the invention embodied in an alternative clamp structure.

An alternative clamp structure into which the present invention may be incorporated is shown in FIG. 8 and corresponds to the interchangeable clamp disclosed in U.S. patent application Ser. No. 07/435,822, assigned to the assignee of the present invention and incorporated herein by reference.

The clamp 210 illustrated in FIG. 8 includes a plurality of interchangeable members 250, 252, 254 which are held together by securing means 256. The clamp 210 further includes a connector 258 for mounting the clamp 210 to a sewing machine. The interchangeable members 250, 252, 254, securing means 256 and connector 258 operate in the manner disclosed in the above-referenced U.S. patent application whereby the interchangeable members 250, 252, 254 are secured together by the securing means 256 to form a preselected configuration for the clamp 210, and the clamp 210 is attached to a sewing machine by the connector 258. In addition, the interchangeable members 250, 252, 254 are provided with presser members 226 which are adjustable to clamp workpieces of varying thicknesses in the same manner as disclosed above with regard to the previous embodiment.

While the forms of apparatus herein described constitute preferred embodiments of the invention, it is to be understood that the invention is not limited to these precise forms of apparatus, and that changes may be made therein without departing from the scope of the invention which is defined in the appended claims.

What is claimed is:

1. A clamp for securing a workpiece against a clamping surface in a sewing machine, said clamp comprising:

a frame for mounting on the sewing machine and also for positioning above the workpiece; and at least one adjustable presser member supported by said frame, said at least one adjustable presser member being adjustable to permit the clamp to apply a preselected amount of pressure sufficient to firmly hold the workpiece in position on the clamping surface so that the workpiece can be sewn by the sewing machine.

2. The clamp as recited in claim 1 wherein said at least one presser member includes an engaging surface extending below said frame for engaging the workpiece.

3. The clamp as recited in claim 1 wherein a plurality of presser members are provided for engaging the workpiece.

4. The clamp as recited in claim 3 wherein each said presser member has a workpiece engaging portion spaced from the frame, said workpiece engaging portion is adapted for contact with the workpiece, and each said presser member is adjustable a preselected amount from said frame to vary the spacing between each said workpiece engaging portion and said frame independently of adjacent presser members.

5. The clamp as recited in claim 3 wherein said presser members comprise screw members having workpiece engaging portions spaced from the frame for contact with the workpiece such that rotation of any one presser member causes the spacing between said workpiece engaging portion of that presser member and said frame to be altered.

6. The clamp as recited in claim 1 wherein said at least one presser member extends from an upper side of said frame to a lower side of said frame to engage the workpiece under said frame.

7. The clamp as recited in claim 1 wherein said at least one presser member includes a workpiece engaging surface and the spacing between said workpiece engaging portion and said frame may be varied with varying thickness of the workpiece.

8. The clamp as recited in claim 7 including a resilient biasing element to resiliently bias said presser member away from said frame into engagement with the workpiece.

9. A method of clamping a workpiece to a clamping surface in a sewing machine, said method comprising the steps of:

positioning a clamp frame in operative relationship with said clamping surface; and adjusting a presser member relative said clamp frame to apply a preselected amount of pressure to said workpiece on said clamping surface.

10. The method as recited in claim 9 wherein said step of adjusting said presser member includes moving an engaging surface on said presser member toward and away from said clamp frame.

11. The method as recited in claim 9 wherein said step of adjusting said presser member includes moving a plurality of screw members relative to said clamp frame to position a plurality of engaging surfaces associated with said screw members in a preselected spaced relationship to said clamp frame.

12. The method as recited in claim 9 wherein said step of adjusting said presser members such that they can accommodate a workpiece which varies in thickness.

13. A clamp for securing a workpiece having a varying thickness against a clamping surface, said clamp comprising:

a frame for mounting on the sewing machine and also for positioning above the workpiece; and a presser member mounted to said frame for engaging the workpiece wherein said presser member is adjustable relative to said frame such that said presser member is engageable with portions of the workpiece having different thicknesses to apply a preselected amount of pressure sufficient to firmly hold each of said portions of the workpiece in position on the clamping surface so that the workpiece can be sewn within the frame by a sewing machine.

14. The clamp as recited in claim 13 wherein said presser member comprises a plurality of elements extending from said frame toward the workpiece.

15. The clamp as recited in claim 14 wherein the extension of each of said elements from said frame is independently variable.

16. The clamp as recited in claim 14 wherein each of said elements defines an engaging surface for engaging one of said portions of the workpiece.

17. The clamp as recited in claim 16 wherein said elements comprise a plurality of screw members threadably engaged with said frame.

18. The clamp as recited in claim 14 wherein each of said elements is a biasing member for biasing an engaging portion of said presser member into engagement with said portions of the workpiece.

19. The clamp as recited in claim 18 wherein said elements comprise a plurality of spring members and said engaging portion comprises a continuous member extending between said spring members and resiliently biasing away from said frame by said spring members.

20. A sewing machine for sewing a predetermined stitch pattern on a workpiece, said sewing machine comprising:

a sewing head;

a clamping surface;

a moveable clamp support; and a clamp including a frame mounted to said movable clamp support above the clamping surface and an adjustable presser member supported by said frame wherein an engaging portion of said presser member is movable relative to said frame to engage the workpiece.

21. The sewing machine as recited in claim 20 including a detachable connector for detachably mounting said frame to said movable clamp support.

22. The sewing machine as recited in claim 20 wherein said presser member comprises a plurality of elements extending from said frame toward the workpiece, said elements being adjustable to accommodate varying thicknesses of the workpiece.

23. The clamp as recited in claim 1 including a connector supporting said frame for movement of the frame toward and away from the clamping surface.

24. A method as recited in claim 9 wherein said clamp includes multiple presser members with engaging surfaces; said method including the additional step of:

adjusting the spacing between the clamp frame and said engaging surfaces such that the spacing of each engaging surface from the clamp frame is related to the thickness of the workpiece where contacted by that engaging surface.

25. A clamp for securing a workpiece against a clamping surface in a sewing machine, said clamp comprising:

a frame for mounting on the sewing machine; and a plurality of presser members supported by said frame, each presser member being adjustable and having a workpiece engaging surface spaced from said frame to apply a preselected amount of pressure sufficient to firmly hold the workpiece in position on the clamping surface so that the workpiece can be sewn within the frame by the sewing machine;

wherein a spacing from the frame to the workpiece engaging portion of a first of said presser members is different than a spacing from said frame to the workpiece engaging portion of a second of said presser members.

26. The clamp as recited in claim 1 wherein said frame includes a central aperture defining a stitch area and said at least one adjustable presser member is adjustable to permit the clamp to apply a preselected amount of pressure to the workpiece on the clamping surface generally outside said stitch area.

27. A clamp for securing a workpiece against a clamping surface in a sewing machine, said clamp comprising:

a frame for mounting on the sewing machine, said frame defining a lower surface; and adjustable presser means defining a plurality of points of contact for engagement with said workpiece, said adjustable presser means including at least three independently adjustable means for independently adjusting spacings between said points of contact and said lower surface so that said adjustable presser member applies a preselected amount of pressure to the workpiece to hold the workpiece so that it can be sewn within the frame by the sewing machine.

28. The clamp as recited in claim 27 including at least one connector coupled to said frame for positioning said frame in the sewing machine.

29. The clamp as recited in claim 27 wherein said frame includes a central aperture defining a stitch area for sewing the workpiece.

30. The clamp as recited in claim 27 wherein said at least three independently adjustable means includes at least three springs.

31. The clamp as recited in claim 27 wherein said at least three independently adjustable means are threadedly coupled to said frame.

32. The clamp as recited in claim 27 wherein said at least three independently adjustable means define engaging surfaces and said points of contact lie on said engaging surfaces.

* * * * *